US005685379A

United States Patent [19]

Barr et al.

[11] Patent Number: 5,685,379

[45] Date of Patent: Nov. 11, 1997

[54] METHOD OF OPERATING A STEERABLE ROTARY DRILLING SYSTEM

[75] Inventors: John D. Barr, Cheltenham; John M. Clegg, Bristol; William C. Motion, Prestbury, all of England

[73] Assignee: Camco Drilling Group Ltd. of Hycalog, Stonehouse, England

[21] Appl. No.: 604,317

[22] Filed: Feb. 21, 1996

[30] Foreign Application Priority Data

Feb. 25, 1995 [GB] United Kingdom ..... 9503829

[51] Int. Cl.[6] ..... E21B 7/06

[52] U.S. Cl. ..... 175/61; 175/73

[58] Field of Search ..... 175/61, 73, 76

[56] References Cited

U.S. PATENT DOCUMENTS

| | | | |
|---|---|---|---|
| 5,520,255 | 5/1996 | Barr et al. | 175/73 X |
| 5,553,679 | 9/1996 | Thorp | 175/61 X |

FOREIGN PATENT DOCUMENTS

| | | |
|---|---|---|
| 2257182 | 1/1993 | United Kingdom . |
| 2259316 | 3/1993 | United Kingdom . |
| 2289909 | 12/1995 | United Kingdom . |

*Primary Examiner*—David J. Bagnell

[57] ABSTRACT

A steerable rotary drilling system comprises a bottom hole assembly which includes, in addition to a drill bit, a modulated bias unit and a control unit including an instrument carrier which is rotatable relative to the bias unit. The bias unit comprises a number of hydraulic actuators spaced apart around the periphery of the unit, each having a movable thrust member which is displaceable outwardly for engagement with the formation. Each actuator can be connected, through a rotatable control valve, to a source of drilling fluid under pressure, the control valve comprising a first part, rotatable with the instrument carrier, which cooperates with a second part which is rotatable with the bias unit. Means are provided to roll stabilize the instrument carrier so that relative rotation between the bias unit and instrument carrier, as the bias unit rotates, causes the valve to operate the actuators in synchronism with rotation of the bias unit so as to apply a lateral bias thereto. In order to neutralize or reduce the net bias applied to the bias unit the instrument carrier may be rotated in various modes instead of being roll stabilized, e.g., it may be rotated at a constant slow speed relative to the bias unit, or at a significantly faster rate so that the actuators do not have time to operate fully. The angular velocity of the carrier may also be varied during its rotation, according to various formulae, in order to vary the net bias. The net bias may also be varied by alternating different modes of carrier rotation.

25 Claims, 3 Drawing Sheets

METHOD OF OPERATING A STEERABLE ROTARY DRILLING SYSTEM

BACKGROUND OF THE INVENTION

1. Field of Invention

The invention relates to steerable rotary drilling systems. When drilling or coring holes in subsurface formations, it is sometimes desirable to be able to vary and control the direction of drilling, for example to direct the borehole towards a desired target, or to control the direction horizontally within the payzone once the target has been reached. It may also be desirable to correct for deviations from the desired direction when drilling a straight hole, or to control the direction of the hole to avoid obstacles.

2. Setting on the Invention

A rotary drilling system is defined as a system in which a bottom hole assembly, including the drill bit, is connected to a drill string which is rotatably driven from the drilling platform at the surface. Hitherto, fully controllable directional drilling has normally required the drill bit to be rotated by a downhole motor. The drill bit may then, for example, be coupled to the motor by a double tilt unit whereby the central axis of the drill bit is inclined to the axis of the motor. During normal drilling the effect of this inclination is nullified by continual rotation of the drill string, and hence the motor casing, as the bit is rotated by the motor. When variation of the direction of drilling is required, the rotation of the drill string is stopped with the bit tilted in the required direction. Continued rotation of the drill bit by the motor then causes the bit to drill in that direction.

Although such arrangements can, under favorable conditions, allow accurately controlled directional drilling to be achieved using a downhole motor to drive the drill bit, there are reasons why rotary drilling is to be preferred, particularly in long reach drilling.

Accordingly, some attention has been given to arrangements for achieving a fully steerable rotary drilling system.

The present invention relates to a steerable rotary drilling system of the kind where the bottom hole assembly includes, in addition to the drill bit, a modulated bias unit and a control unit including an instrument carrier which is rotatable about a longitudinal axis relative to the bias unit, the bias unit comprising a number of actuators at the periphery of the unit, each having a movable thrust member which is displaceable outwardly for engagement with the formation of the borehole being drilled, means being provided to effect roll stabilization of the instrument carrier so that relative rotation between the bias unit and instrument carrier, as the bias unit rotates, operates the actuators in synchronism with rotation of the bias unit so as to apply a lateral bias thereto. In such a system the direction of bias is determined by the rotational orientation in space, or roll angle, of the roll stabilized instrument carrier.

In a preferred form of bias unit each actuator is a hydraulic actuator having an inlet passage for connection, through a rotatable selector control valve, to a source of drilling fluid under pressure, the control valve comprising a fast part, rotatable with the instrument carrier, which cooperates with a second part which is rotatable with the bias unit, so that relative rotation between the valve parts, as the bias unit rotates, modulates the fluid pressure supplied to the actuators. British Patent Specifications Nos. 2259316 and 9411228.1 describe and claim various modulated bias units of this kind for use in a steerable rotary drilling system, and suitable forms of roll stabilized control unit are described in British Patent Specification No. 2257182 and co-pending U.S. application Ser.No. 08/604,318.

In the systems described in the latter two specifications, the instrument carrier is mounted within a drill collar for rotation about the longitudinal axis of the collar. An impeller, or, preferably, two contra-rotating impellers, are mounted on the instrument carrier so as to rotate the carrier relative to the drill collar as a result of the flow of drilling fluid along the drill collar during drilling. The torque transmitted by the impellers to the instrument carrier is controlled, in response to signals from sensors in the carrier which respond to the rotational orientation of the carrier, and input signals indicating the required roll angle of the carrier, so as to rotate the carrier in the opposite direction to the drill collar and at the same speed, so as to maintain the carrier non-rotating in space and hence roll stabilized.

In a preferred arrangement the torque is controlled by controlling a variable electromagnetic coupling between each impeller and the carrier. The two impeller arrangement provides sufficient control over the torque so that, in addition to permitting roll stabilization of the carrier, the carrier may also be rotated in either direction and at any achievable speed in space or relative to the drill collar.

In operation of a steerable rotary drilling system of the above kind, it is sometimes required to reduce, neutralize or turn off the biasing effect of the modulated bias unit. In order to turn off the bias unit additional mechanical hardware may be provided in the system. For example, auxiliary valve means may be provided to shut off the supply of drilling fluid to the control valve, or from the control valve to the bias unit, so as to render the bias unit inoperative. Such an arrangement is described in our co-pending U.S. application Ser. No. 08/604,318.

However, it is also possible to neutralize or reduce the biasing effect of such a modulated bias unit solely by the manner in which the bias unit is operated, and without any modification being necessary to the structure of the bias unit or associated control unit. For example, in a method known in the prior art, the control valve may be operated at a rate which is not in synchronism with rotation of the bias unit. This is achieved by rotating the instrument carrier in space, asynchronously with the bias unit, instead of maintaining it roll stabilized. As a result of the consequent asynchronous operation of the control valve, the operation of the hydraulic actuators of the bias unit is not synchronized with its rotation so the direction of the bias in space is constantly changing. Consequently the associated drill bit drills the borehole in a shallow spiral so that the mean bias provided by the system is zero and, over a significant length of borehole, the overall direction of the borehole is unchanged by the operation of the bias unit.

One disadvantage of this arrangement is that, although there is no net bias, the hydraulic actuators of the bias unit are still operating in succession at full bias, as though steering were still being effected. This means that all parts of the actuators continue to suffer maximum wear, to no purpose.

The present invention sets out to provide methods of operating a steered rotary drilling system of the kind first referred to so as reduce the biasing effect during drilling, and also further and improved methods of neutralizing the biasing effect.

The invention is applicable to the use of a bias unit having only a single hydraulic actuator, but preferably there are provided a plurality of hydraulic actuators spaced apart around the periphery of the unit, the control valve then being operable to bring the actuators successively into and out of communication with the source of fluid under pressure, as the bias unit rotates.

SUMMARY OF THE INVENTION

According to a first aspect of the invention there is provided a method of operating a bias unit of the kind first referred to comprising temporarily rotating said instrument carrier at a substantially constant speed relative to the actual speed of rotation of the bias unit, for a period, to neutralize or reduce the net bias per revolution applied to the bias unit during said period. This is distinguished from the prior art method, referred to above, where the instrument carrier is rotated at a constant speed in space. In this specification, where reference is made to the instrument carrier being rotated "in space," it is to be understood that such rotation is controlled rotation measured in relation to a fixed datum in space determined according to the output of gravity and/or magnetic and/or angular inertial sensor(s) in the instrument package in the instrument carrier of the control unit. It does not include arrangements where the instrument carrier is rotated relative to some other datum, such as the drill collar, which is not normally fixed in space.

According to this aspect of the invention, and also according to the other aspects of the invention referred to below, each actuator is preferably a hydraulic actuator having an inlet passage for connection, through a rotatable selector control valve, to a source of drilling fluid under pressure, the control valve comprising a first part, rotatable with the instrument carrier, which cooperates with a second part which is rotatable with the bias unit, so that relative rotation between the valve parts, as the bias unit rotates, modulates the fluid pressure supplied to the actuators.

Said substantially constant relative speed may be zero, whereby the instrument carrier rotates with the bias unit, so that the actuators are not operated as the bias unit rotates. Accordingly, as the bias unit rotates, the actuators remain in the same positions and the direction of the lateral bias applied by the actuators therefore rotates with the bias unit, and thus the net directional effect of such bias is zero. In this case the application of a lateral bias rotating with the drill bit may have the effect of causing the bit to operate as a so-called "anti-whirl" bit, which may be advantageous since it is believed that drill bits of appropriate design operating under a constant rotating lateral bias may have less tendency to whirl, i.e., to precess around the walls of the borehole as they rotate.

However, the application of a constant lateral bias to the bias unit and drill bit may have the effect of causing accelerated wear to the gauge trimming cutters of the drill bit which lie diametrically opposite to the actuator of the bias unit which is fully extended. In a preferred modification of this method of operation, therefore, the actuators are not caused to cease operating entirely, but instead are successively operated at a slow rate, by rotating the instrument carrier relative to the bias unit at a rate which is slower than the rate of rotation of the bias unit itself. This has the effect of slowly operating the actuators in succession so that wear is shared between all areas of the gauge of the drill bit around its periphery and between the actuators. However, since the direction of bias is changing only slowly, a suitable drill bit may still act as an "anti-whirl" bit.

The above methods may include the step of sensing the angular position of the instrument carrier, and/or the rate of change of said angular position, relative to a part, such as a drill collar, rotating with the bias unit, and controlling rotation of the instrument carrier to maintain said angular position or said rate of change substantially constant. For convenience, rotation of the instrument carrier under such control will be referred to as the "collar mode."

According to a second aspect of the invention, there is provided a method of operating a modulated bias unit of the kind first referred to comprising temporarily rotating the instrument carrier at a rate relative to the bias unit which is significantly faster than the rate of rotation of the bias unit and at a rate such that each actuator of the bias unit cannot fully respond each time it is operated, whereby the outward displacement of the movable thrust member of each actuator remains at less than its normal maximum outward displacement.

In practice the rate of rotation of the instrument carrier is selected so that the thrust member of each actuator oscillates rapidly, and at small amplitude, about a displacement position intermediate its innermost and outermost positions. In the case where a number of actuators are provided, therefore, the effect is substantially equivalent to all the thrust members being extended outwardly by a reduced amount, and there is no net biasing effect due to the thrust members.

A third method according to the invention comprises rotating the instrument carrier in space, during drilling, and varying its angular velocity in a manner to reduce the bias effect, or net bias effect, of the bias unit, rather than neutralizing it.

The angular velocity of the instrument carrier may be varied as a function of the angular position of the instrument carrier in space.

In the case where the angular velocity is varied as a function of the angular position of the instrument carrier, $1/\dot{\theta}$ may be correlated with $\cos(\theta-\theta_o)$, where:

$\dot{\theta}$=angular velocity of the instrument carrier in space $\theta$=angular position of the instrument carrier in space $\theta_o$=angular position in space of the instrument carrier which corresponds to the angular position of the bias unit at which bias is to be applied Thus, as the instrument carrier rotates, its angular velocity $\dot{\theta}$ varies and is a minimum when it is near the position where $\theta=\theta_o$, which is the angular position of the instrument carrier corresponding to the specified angular position of the bias unit at which maximum bias is to be applied.

In other words, due to the rotation of the instrument carrier in space, the direction of bias rotates with the carrier, thus reducing the net bias per revolution. If the carrier rotates at constant speed the net bias is reduced to zero, as in the prior art method referred to above. However, since the carrier moves more slowly near the angular position $\theta_o$, the bias is applied for a longer period and thus has a greater effect than the bias applied around the rest of each rotation, so that the net bias is not reduced to zero, but is a reduced bias in the specified direction corresponding to $\theta_o$.

For example, the angular velocity may vary cyclically during each revolution of the carrier, according to the formula: $\dot{\theta}=\omega(1-b\cos(\theta-\theta_o))$ where $\omega$=mean angular velocity of the carrier b=constant dependent on the required build rate The angular velocity $\dot{\theta}$ of the carrier may be any other function of the angular position which gives a similar effect of reducing the net bias per revolution.

In an alternative method the carrier may be so controlled that instead of rotating continuously in one direction, it is caused to perform angular oscillations about the angular position o, the angular velocity again being varied so that it is a minimum at=$\theta-\theta_o$.

In such an oscillating mode, the angular velocity of the carrier may also be varied with time. For example, it may be varied by controlling the angular position of the carrier according to the formula:

$\theta=\theta_o+a \sin \omega t$ where: t=time and a=constant

Other methods may be employed for achieving reduced or zero means bias by varying the angular velocity of the instrument carrier with time.

For example, periods when the carrier is substantially stationary in space, causing maximum bias in the specified direction, may be alternated with periods when the carrier is rotating in space, causing zero or reduced net bias per revolution. This will cause a mean bias which is reduced when compared with the mean bias had the carrier been stationary in space for the whole time. The mean bias is reduced by reducing the duration of the periods when the carrier is stationary in relation to the periods when it is rotating.

The effective bias of a steerable rotary drilling system of the kind referred to may also be varied by alternating any of the modes of operation referred to above, on a time-sharing basis. For example, periods when the carrier is substantially stationary in space may be alternated with periods when the carrier is rotating, relative to the bias unit or in space, according to any of the modes of operation previously described.

DETAILED DESCRIPTION OF THE PREFERRED EMBODIMENTS

Figure 1:
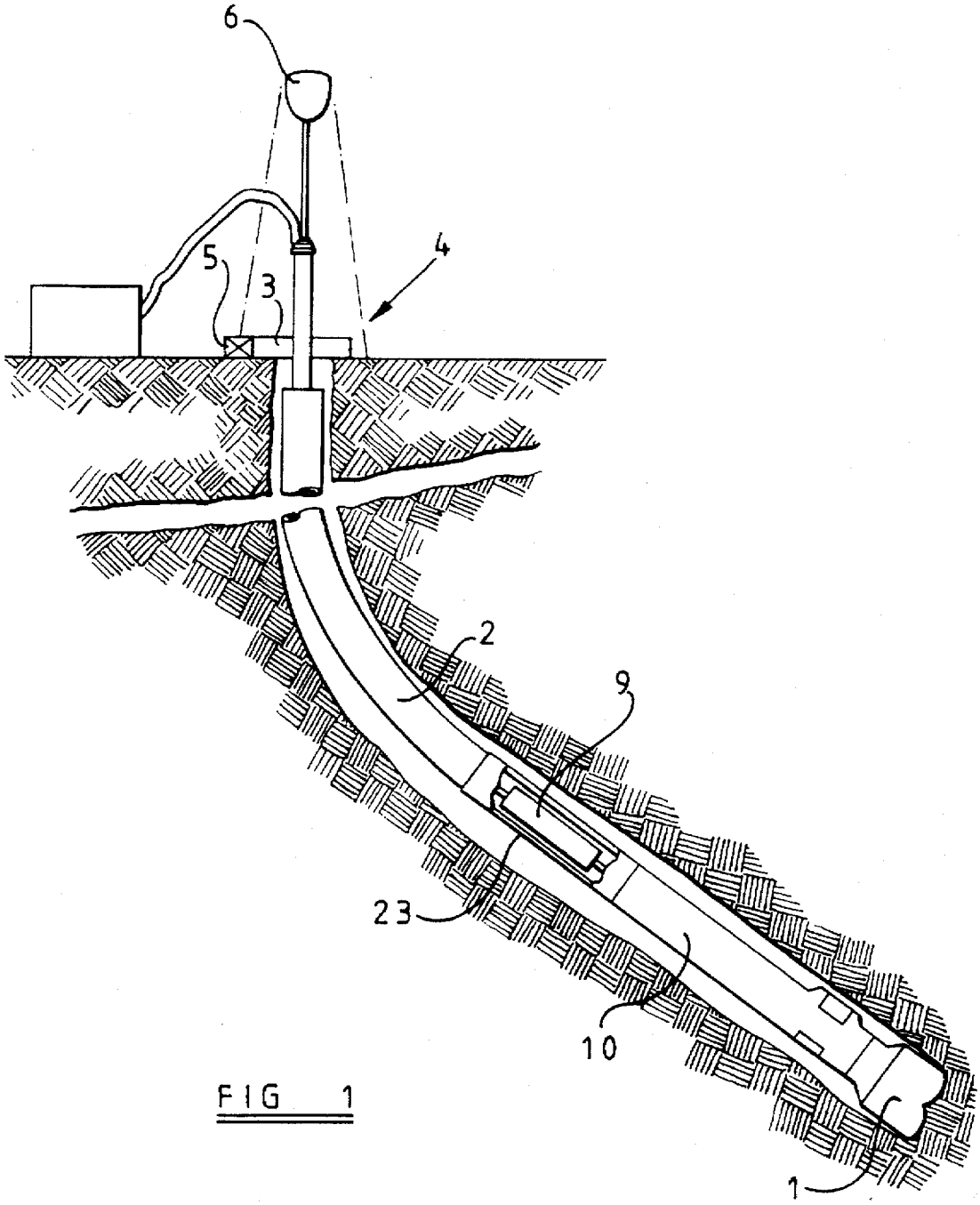
FIG. 1 is a diagrammatic sectional representation of a deep hole drilling installation.

FIG. 1 shows diagrammatically a typical rotary drilling installation of a kind in which the methods according to the present invention may be employed.

In the following description the terms "clockwise" and "anti-clockwise" refer to the direction of rotation as viewed looking downhole.

As is well known, the bottom hole assembly includes a drill bit 1, and is connected to the lower end of a drill string 2 which is rotatably driven from the surface by a rotary table 3 on a drilling platform 4. The rotary table is driven by a drive motor indicated diagrammatically at 5 and raising and lowering of the drill string, and application of weight-on-bit, is under the control of draw works indicated diagrammatically at 6.

The bottom hole assembly includes a modulated bias unit 10 to which the drill bit 1 is connected and a roll stabilized control unit 9 which controls operation of the bias unit 10 in accordance with an onboard computer program, and/or in accordance with signals transmitted to the control unit from the surface. The bias unit 10 may be controlled to apply a lateral bias to the drill bit 1 in a desired direction so as to control the direction of drilling.

Figure 2:
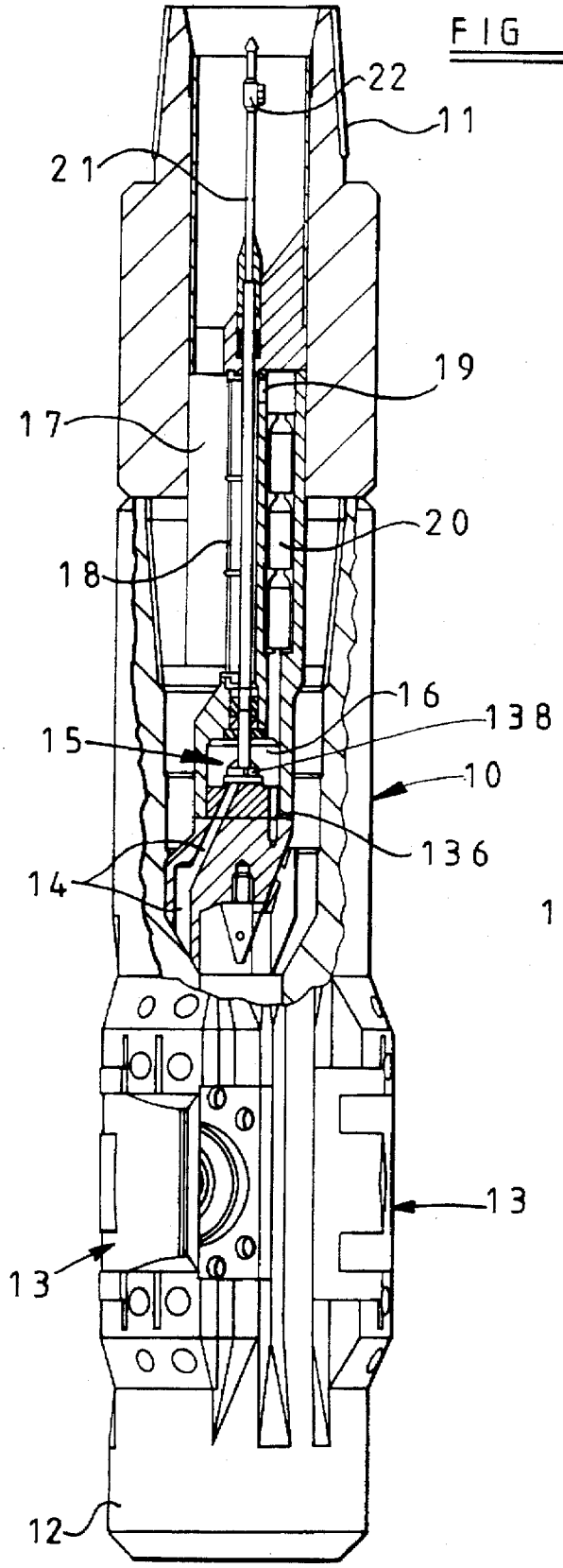
FIG. 2 is a part-longitudinal section, part side elevation of a prior art modulated bias unit of the kind to which the present invention may be applied.

Referring to FIG. 2, the bias unit 10 comprises an elongate main body structure provided at its upper end with a threaded pin 11 for connecting the unit to a drill collar, incorporating the roll stabilized control unit 9, which is in turn connected to the lower end of the drill string. The lower end 12 of the body structure is formed with a socket to receive the threaded pin of the drill bit.

There are provided around the periphery of the bias unit, towards its lower end, three equally spaced hydraulic actuators 13. Each hydraulic actuator 13 is supplied with drilling fluid under pressure through a respective passage 14 under the control of a rotatable disc valve 15 located in a cavity 16 in the body structure of the bias unit.

Drilling fluid delivered under pressure downwardly through the interior of the drill string, in the normal manner, passes into a central passage 17 in the upper part of the bias unit, through a filter 18 consisting of closely spaced longitudinal wires, and through an inlet 19 into the upper end of a vertical multiple choke unit 20 through which the drilling fluid is delivered downwardly at an appropriate pressure to the cavity 16.

The disc valve 15 is controlled by an axial shaft 21 which is connected by a coupling 22 to the output shaft of the control unit, which can be roll stabilized.

The control unit, when roll stabilized (i.e., non-rotating in space) maintains the shaft 21 substantially stationary at a rotational orientation which is selected, either from the surface or by a downhole computer program, according to the direction in which the drill bit is to be steered. As the bias unit rotates around the stationary shaft 21 the disc valve 15 operates to deliver drilling fluid under pressure to the three hydraulic actuators 13 in succession. The hydraulic actuators are thus operated in succession as the bias unit rotates, each in the same rotational position so as to displace the bias unit laterally in a selected direction. The selected rotational position of the shaft 21 in space thus determines the direction in which the bias unit is actually displaced and hence the direction in which the drill bit is steered.

Figure 3:
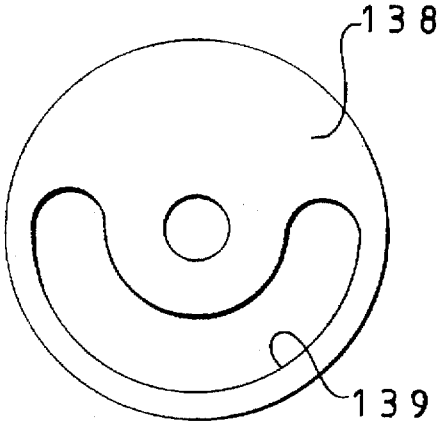
FIGS. 3 and 4 are plan views of the two major components of the disc valve employed in the prior art bias unit.
Figure 4:
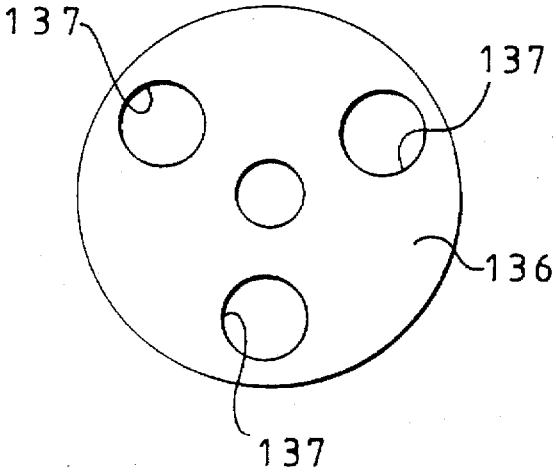

FIGS. 3 and 4 show in greater detail the construction of the components of the disc valve 15. The disc valve comprises a lower disc 136 which is fixedly mounted, for example by brazing or glueing, on a fixed part of the body structure of the bias unit. The lower disc 136 comprises an upper layer of polycrystalline diamond bonded to a thicker substrate of cemented tungsten carbide. As best seen in FIG. 4 the disc 136 is formed with three equally circumferentially spaced circular apertures 137 each of which registers with a respective passage 14 in the body structure of the bias unit.

The upper disc 138 is brazed or glued to a shaped element on the lower end of the shaft 21 and comprises a lower facing layer of polycrystalline diamond bonded to a thicker substrate of tungsten carbide. As best seen in FIG. 3, the disc 138 is formed with an arcuate aperture 139 extending through approximately 180. The arrangement is such that as the lower disc 136 rotates beneath the upper disc 138 (which is held stationary, with the shaft 21, by the aforementioned roll stabilized control unit 9) the apertures 137 are successively brought into communication with the aperture 139 in the upper disc so that drilling fluid under pressure is fed from the cavity 16, through the passages 14, and to the hydraulic actuators in succession. It will be seen that, due to the angular extent of the aperture 139, a following aperture 137 begins to open before the previous aperture has closed.

In order to locate the discs 136 and 138 of the disc valve radially, an axial pin of polycrystalline diamond may be received in registering sockets in the two discs.

Figure 5:
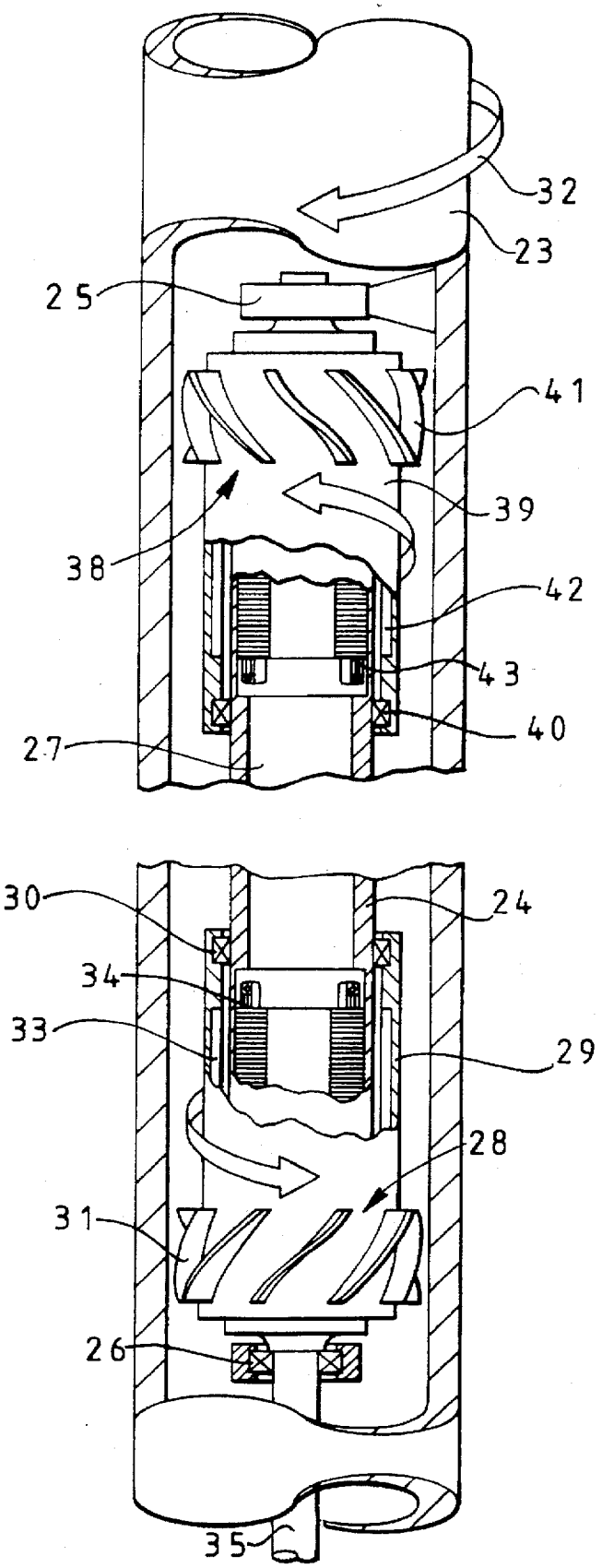
FIG. 5 is a diagrammatic longitudinal section through a roll stabilized instrumentation package, acting as a control unit for the bias unit of FIGS. 2–4.

FIG. 5 shows diagrammatically, in greater detail, one form of roll stabilized control unit for controlling a bias unit of the kind shown in FIG. 2. Other forms of roll stabilized control unit are described in British Patent Specification No. 2257182, and in co-pending U.S. application Ser. No. 08/604,318 [Attorney Docket No. PO3181US].

Referring to FIG. 5, the support for the control unit comprises a tubular drill collar 23 forming part of the drill string. The control unit comprises an elongate generally cylindrical hollow instrument carrier 24 mounted in bearings 25, 26 supported within the drill collar 23, for rotation relative to the drill collar 23 about the central longitudinal axis thereof. The carrier has one or more internal compartments which contain an instrument package 27 comprising sensors for sensing the orientation and rotation of the control unit in space, and associated equipment for processing signals from the sensors and controlling the rotation of the carrier.

As previously referred to, some methods according to the present invention require control of the speed of rotation and/or angular position of the instrument carrier relative to the bias unit, instead of control of its rotation in space. In order to permit such control, the instrument package in the instrument carrier includes an appropriate sensor to determine the angular position of the carrier relative to the drill collar, and hence to the bias unit, and/or the rate of change of said angular position. Such sensor may comprise, for example, two spaced permanent magnets mounted at diametrically opposed locations on the drill collar cooperating with two differently orientated magnetometers in the instrument carrier.

At the lower end of the control unit a multi-bladed impeller 28 is rotatably mounted on the carrier 24. The impeller comprises a cylindrical sleeve 29 which encircles the carrier and is mounted in beatings 30 thereon. The blades 31 of the impeller are rigidly mounted on the lower end of the sleeve 29. During drilling operations the drill string, including the drill collar 23, will normally rotate clockwise, as indicated by the arrow 32, and the impeller 28 is so designed that it tends to be rotated anti-clockwise as a result of the flow of drilling fluid down the interior of the collar 23 and across the impeller blades 31.

The impeller 28 is coupled to the instrument carrier 24, by an electrical torquer-generator. The sleeve 29 contains around its inner priphery a pole structure comprising an array of permanent magnets 33 cooperating with an armature 34 fixed within the carrier 24. The magnet/armature arrangement serves as a variable drive coupling between the impeller 28 and the carrier 24.

A second impeller 38 is mounted adjacent the upper end of the carrier 24. The second impeller is, like the first impeller 28, also coupled to the carrier 24 in such a manner that the torque it imparts to the carrier can be varied. The upper impeller 38 is generally similar in construction to the lower impeller 28 and comprises a cylindrical sleeve 39 which encircles the carrier casing and is mounted in bearings 40 thereon. The blades 41 of the impeller are rigidly mounted on the upper end of the sleeve 39. However, the blades of the upper impeller are so designed that the impeller tends to be rotated clockwise as a result of the flow of drilling fluid down the interior of the collar 23 and across the impeller blades 41.

Like the impeller 28, the impeller 38 is coupled to the carrier 24, by an electrical torquer-generator. The sleeve 39 contains around its inner periphery an array of permanent magnets 42 cooperating with a fixed armature 43 within the casing 24. The magnet/armature arrangement serves as a variable drive coupling between the impeller 38 and the carrier.

As the drill collar 23 rotates during drilling, the main bearings 25, 26 and the disc valve 15 of the bias unit apply a clockwise input torque to the carrier 24 and a further clockwise torque is applied by the upper impeller 38. These clockwise torques are opposed by an anti-clockwise torque applied to the carrier by the lower impeller 28. The torque applied to the carrier 24 by each impeller may be varied by varying the electrical load on each generator constituted by the magnets 33 or 42 and the armature 34 or 43. This variable load is applied by a generator load control unit under the control of a microprocessor in the instrument package 27. During steered drilling there are fed to the processor an input signal dependent on the required rotational orientation (roll angle) of the carrier 24 in space, and on feedback signals from roll sensors included in the instrumentation package 27. The input signal may be transmitted to the processor from a control unit at the surface, or may be derived from a downhole computer program defining the desired path of the borehole being drilled.

The processor is preprogrammed to process the feedback signal which is indicative of the rotational orientation of the carrier 24 in space, and the input signal which is indicative of the desired rotational orientation of the carrier, and to feed a resultant output signal to the generator load control unit. The output signal is such as to cause the generator load control unit to apply to each of the torquer-generators 33, 34 and 42,43 an electrical load of such magnitude that the net anticlockwise torque applied to the carrier 24 by the two torquer-generators opposes and balances the other clockwise torques applied to the carrier, such as the bearing and valve torques, so as to maintain the carrier non-rotating in space, and at the rotational orientation demanded by the input signal.

The output from the control unit 9 is provided by the rotational orientation of the unit itself and the carrier is thus mechanically connected by a single control shaft 35 to the input shaft 21 of the bias unit 10 shown in FIG. 2.

Since the torque applied by each impeller may be independently controlled, control means in the instrument package may control the two impellers in such manner as to cause any required net torque, within a permitted range, to be applied to the carrier. This net torque will be the difference between the clockwise torque applied by the upper impeller 38, bearings etc. and the anticlockwise torque applied by the lower impeller 28. The control of net torque provided by the two impellers may therefore be employed to cause the control unit to perform rotations or part-rotations in space, or relative to the drill collar 23, either clockwise or anti-clockwise or in a sequence of both, and at any angular velocity within a permitted range.

The present invention provides methods of operating the bias unit of the kind shown in FIG. 2 to achieve neutral or reduced bias, by appropriate control of the rotation of the instrument carrier 24.

According to one such method, the control unit 9 is instructed, by preprogramming of the downhole processor or by a signal from the surface, to rotate the instrument carrier 24, and hence the shaft 21, at zero speed relative to the bias unit 10, using the aforementioned "collar mode," so that relative rotation between the discs 36 and 38 of the control valve 15 ceases. Depending on the position of the control valve 15 at the moment when relative rotation between the discs ceases, one or two of the hydraulic actuators 13 will have been extended and will thus remain extended since they will now remain permanently in communication with the drilling fluid under pressure as the bias unit rotates.

However, the direction of the bias provided by the operative actuator will now rotate with the bias unit so as to provide no net bias over a complete rotation.

Accordingly, the drill bit will continue to drill an essentially straight hole until such time as the control unit and shaft 21 are again roll stabilized and stationary in space, so that operation of the valve 15 again begins.

Since such a method will cause disproportionate wear to the gauge trimmers on one side of a PDC drill bit and to the actuator or actuators which happen to be extended, it is preferable in this mode of operation for the actuators to be slowly operated in sequence, at a speed which is less than the speed of rotation of the bias unit, so that they continue to have no net biasing effect. However, with such an arrangement each actuator then goes through a period when it is operated so that the wear is shared equally between the three actuators. This is achieved by slowly rotating the instrument carrier 24 and shaft 21 relative to the drill collar 23. Typically, when the speed of rotation of the bias unit red drill bit is 100 rpm, the speed of rotation of the carrier 24 and shaft 21 relative to the drill collar 23 might be 0.1 to 10 rpm.

In an alternative method of operation in accordance with the invention neutral bias is achieved by instructing the control unit 9 to rotate the carrier 24 and shaft 21, clockwise or anti-clockwise, at a speed relative which is significantly greater than the speed of rotation of the bias unit. Typically, where the speed of rotation of the bias unit is 200 rpm, the speed of rotation of the shaft 21 might be 700–800 rpm. The carrier may be rotated in space, relative to the drill collar 23, or under no control.

When the control valve 15 is operated at such high speed, the actuators 13 have insufficient time to respond fully to being placed into communication with the drilling fluid under pressure and each actuator does not therefore extend fully before it is disconnected from the fluid pressure and the next actuator is connected. As a result, all of the actuators tend to settle down into a position where they oscillate at a small amplitude about an intermediate extended position. Consequently, no actuator has any greater effect than any other actuator and the biasing effect of the actuators is therefore neutralized, so that the drill bit drills without bias.

As previously mentioned, according to the invention the net bias effect, or mean bias effect, of the bias unit 10 may also be reduced by varying the angular velocity of the instrument carrier 24 as a function of the angular position of the instrument carrier in space, or as a function of time.

Thus, the impellers 28, 38 may be so controlled, from the downhole program signals from the surface, or a combination of both, to vary the rotation speed demanded of the instrument carrier 24 as a function of angular position or time to impose the required pattern of variation in angular velocity on the instrument carrier.

For example, the impellers may be so controlled that the angular velocity varies cyclically during each revolution of the carrier.

In the case where the angular velocity is varied as a function of the angular position of the instrument carrier, $1/\dot{\theta}$ may be correlated with Cos $(\theta-\theta_o)$, where:

$\dot{\theta}$=angular velocity of the instrument carrier in space $\theta$=angular position of the instrument carrier in space $\theta_o$=angular position in space of the instrument carrier which corresponds to the angular position of the bias unit at which bias is to be applied Thus, as the instrument carrier rotates, its angular velocity $\dot{\theta}$ varies and is a minimum when it is near the position where $\theta-\theta_o$, which is the angular position of the instrument carrier corresponding to the specified angular position of the bias unit at which maximum bias is to be applied.

In other words, due to the rotation of the instrument carrier in space, the direction of bias rotates with the carrier, thus reducing the net bias per revolution. If the carrier rotates at constant speed the net bias is reduced to zero, as in the prior art method referred to above. However, since the carrier moves more slowly near the angular position $\theta_o$, the bias is applied for a longer period and thus has a greater effect than the bias applied around the rest of each rotation, so that the net bias is not reduced to zero, but is a reduced bias in the specified direction corresponding to $\theta_o$.

For example, the angular velocity may vary cyclically during each revolution of the carrier, according to the formula: $\dot{\theta}=\omega(1\text{-}b \text{ Cos } (\theta-\theta_o))$ where $\omega$=mean angular velocity of the carrier b=constant dependent on the required build rate The angular velocity $\dot{\theta}$ of the carrier may be any other function of the angular position which gives a similar effect of reducing the net bias per revolution.

In an alternative method the carrier may be so controlled that instead of rotating continuously in one direction, it is caused to perform angular oscillations about the angular position $\theta_o$, the angular velocity again being varied so that it is a minimum at $\theta=\theta_o$.

In such an oscillating mode, the angular velocity of the carrier may also be varied with time. For example, it may be varied by controlling the angular position of the carrier according to the formula:

$\theta=\theta_o+a \sin \omega t$ where: t=time and a=constant

Other methods may be employed for achieving reduced or zero means bias by varying the angular velocity of the instrument carrier with time.

For example, periods when the carrier is substantially stationary in space, causing maximum bias in the specified direction, may be alternated with periods when the carrier is rotating in space, causing zero or reduced net bias per revolution. This will cause a mean bias which is reduced when compared with the mean bias had the carrier been stationary in space for the whole time. The mean bias is reduced by reducing the duration of the periods when the carrier is stationary in relation to the periods when it is rotating.

The duration of either or both period may be measured in seconds or in revolutions of the carrier.

The effective bias of a steerable rotary drilling system of the kind referred to may also be varied by alternating any of the modes of operation referred to above, on a time-sharing basis. For example, periods when the carrier is substantially stationary in space may be alternated with periods when the carrier is rotating, relative to the bias unit or in space, according to any of the modes of operation previously described.

Thus, the invention includes a method of operation comprising rotating the instrument carrier, for a period, in a manner to neutralize or reduce the net bias per revolution applied to the bias unit during said period, and changing the mode of rotation of the carrier at intervals during said period. The period may include at least one interval during which the instrument carrier is roll stabilized.

In the above examples, the cyclic variation in angular velocity of the carrier is sinusoidal. However, the invention includes within its scope other modes of cyclic variation, for example where the waveform is substantially a triangular or square waveform.

Whereas the present invention has been described in particular relation to the drawings attached hereto, it should be understood that other and further modifications, apart from those shown or suggested herein, may be made within the scope and spirit of the present invention.

What is claimed:

1. A method of operating a steerable rotary drilling system of the kind where a bottom hole assembly includes, in addition to a drill bit, a modulated bias unit and a control unit including an instrument carrier which is rotatable about a longitudinal axis relative to the bias unit, the bias unit comprising a number of actuators at the periphery of the unit, each having a movable thrust member which is displaceable outwardly for engagement with the formation of the borehole being drilled, means being provided to effect roll stabilization of the instrument carrier so that relative rotation between the bias unit and instrument carrier, as the bias unit rotates, operates the actuators in synchronism with rotation of the bias unit so as to apply a lateral bias thereto, the method comprising temporarily rotating said instrument carrier at a substantially constant speed relative to the actual speed of rotation of the bias unit, for a period, to neutralize or reduce the net bias per revolution applied to the bias unit during said period.

2. A method according to claim 1, wherein each actuator is a hydraulic actuator having an inlet passage for connection, through a rotatable selector control valve, to a source of drilling fluid under pressure, the control valve comprising a first part, rotatable with the instrument carrier, which cooperates with a second part which is rotatable with the bias unit, so that relative rotation between the valve parts, as the bias unit rotates, modulates the fluid pressure supplied to the actuators.

3. A method according to claim 1, wherein said substantially constant relative speed is zero, whereby the instrument carrier rotates with the bias unit, so that the actuators are not operated as the bias unit rotates.

4. A method according to claim 1, wherein the actuators are successively operated at a slow rate by rotating the instrument carrier relative to the bias unit at a rate which is slower than the rate of rotation of the bias unit itself.

5. A method according to claim 1, including the step of sensing the angular position of the instrument carrier relative to a part rotating with the bias unit, and controlling rotation of the instrument carrier to maintain said angular position substantially constant.

6. A method according to claim 1, including the step of sensing the rate of change of angular position of the instrument carrier relative to a part rotating with the bias unit, and controlling rotation of the instrument carrier to maintain said rate of change substantially constant.

7. A method according to claim 1, wherein periods when the carrier is substantially stationary in space, causing maximum bias in a specified direction, are alternated with periods when the carrier is rotating in space, causing zero or reduced net bias per revolution.

8. A method of operating a steerable rotary drilling system of the kind where a bottom hole assembly includes, in addition to a drill bit, a modulated bias unit and a control unit including an instrument carrier which is rotatable about a longitudinal axis relative to the bias unit, the bias unit comprising a number of actuators at the periphery of the unit, each having a movable thrust member which is displaceable outwardly for engagement with the formation of the borehole being drilled, means being provided to effect roll stabilization of the instrument carrier so that relative rotation between the bias unit and instrument carrier, as the bias unit rotates, operates the actuators in synchronism with rotation of the bias unit so as to apply a lateral bias thereto, the method comprising temporarily rotating the instrument carrier at a rate relative to the bias unit which is significantly faster than the rate of rotation of the bias unit and at a rate such that each actuator of the bias unit cannot fully respond each time it is operated, whereby the outward displacement of the movable thrust member of each actuator remains at less than its normal maximum outward displacement.

9. A method according to claim 8, wherein each actuator is a hydraulic actuator having an inlet passage for connection, through a rotatable selector control valve, to a source of drilling fluid under pressure, the control valve comprising a first part, rotatable with the instrument carrier, which cooperates with a second part which is rotatable with the bias unit, so that relative rotation between the valve parts, as the bias unit rotates, modulates the fluid pressure supplied to the actuators.

10. A method according to claim 9, wherein the rate of rotation of the instrument carrier is selected so that the thrust member of each hydraulic actuator oscillates rapidly, and at small amplitude, about a displacement position intermediate its innermost and outermost positions.

11. A method according to claim 8, wherein periods when the carrier is substantially stationary in space, causing maximum bias in the specified direction, are alternated with periods when the carrier is rotating in space, causing zero or reduced net bias per revolution.

12. A method of operating a steerable rotary drilling system of the kind where a bottom hole assembly includes, in addition to a drill bit, a modulated bias unit and a control unit including an instrument carrier which is rotatable about a longitudinal axis relative to the bias unit, the bias unit comprising a number of actuators at the periphery of the unit, each having a movable thrust member which is displaceable outwardly for engagement with the formation of the borehole being drilled, means being provided to effect roll stabilization of the instrument carrier so that relative rotation between the bias unit and instrument carrier, as the bias unit rotates, operates the actuators in synchronism with rotation of the bias unit so as to apply a lateral bias thereto, the method comprising rotating the instrument carrier in space, during drilling, and varying its angular velocity in a manner to reduce the bias effect, or net bias effect, of the bias unit.

13. A method according to claim 12, wherein the angular velocity of the instrument carrier is varied as a function of the angular position of the instrument carrier in space.

14. A method according to claim 13, wherein the angular velocity is varied as a function of the angular position of the instrument carrier, and $1/\dot{\theta}$ is correlated with $\cos(\theta-\theta_o)$, where:

$\dot{\theta}$=angular velocity of the instrument carrier in space $\theta$=angular position of the instrument carrier in space $\theta_o$=angular position in space of the instrument carrier which corresponds to the angular position of the bias unit at which bias is to be applied.

15. A method according to claim 14, wherein the angular velocity varies cyclically during each revolution of the carrier, according to the formula: $\dot{\theta}=\omega(1-b\cos(\theta-\theta_o))$ where $\omega$=mean angular velocity of the carrier b=constant dependent on the required build rate.

16. A method according to claim 12, wherein periods when the carrier is substantially stationary in space, causing maximum bias in the specified direction, are alternated with periods when the carrier is rotating in space at varying angular velocity, causing zero or reduced net bias per revolution.

17. A method according to claim 12, wherein each actuator is a hydraulic actuator having an inlet passage for connection, through a rotatable selector control valve, to a source of drilling fluid under pressure, the control valve comprising a first part, rotatable with the instrument carrier, which cooperates with a second part which is rotatable with the bias unit, so that relative rotation between the valve parts, as the bias unit rotates, modulates the fluid pressure supplied to the actuators.

18. A method of operating a steerable rotary drilling system of the kind where a bottom hole assembly includes, in addition to a drill bit, a modulated bias unit and a control unit including an instrument carrier which is rotatable about a longitudinal axis relative to the bias unit, the bias unit comprising a number of actuators at the periphery of the unit, each having a movable thrust member which is displaceable outwardly for engagement with the formation of the borehole being drilled, means being provided to effect roll stabilization of the instrument carrier so that relative rotation between the bias unit and instrument carrier, as the bias unit rotates, operates the actuators in synchronism with rotation of the bias unit so as to apply a lateral bias thereto, the method comprising controlling the carrier to cause it to perform angular oscillations about an angular position $\theta_o$, the angular velocity being varied so that it is a minimum at $\theta-\theta_o$.

19. A method according to claim 18, wherein the angular velocity of the carrier is varied with time.

20. A method according to claim 19, wherein the angular velocity of the carrier is varied by controlling the angular position of the carrier according to the formula:

$$\theta=\theta_o+a \sin \omega t$$

where: t=time and a=constant.

21. A method according to claim 18, wherein periods when the carrier is substantially stationary in space, causing maximum bias in the specified direction, are alternated with periods when the carrier is performing angular oscillations in space, causing zero or reduced net bias per revolution.

22. A method according to claim 18, wherein each actuator is a hydraulic actuator having an inlet passage for connection, through a rotatable selector control valve, to a source of drilling fluid under pressure, the control valve comprising a first part, rotatable with the instrument carrier, which cooperates with a second part which is rotatable with the bias unit, so that relative rotation between the valve parts, as the bias unit rotates, modulates the fluid pressure supplied to the actuators.

23. A method of operating a steerable rotary drilling system of the kind where a bottom hole assembly includes, in addition to a drill bit, a modulated bias unit and a control unit including an instrument carrier which is rotatable about a longitudinal axis relative to the bias unit, the bias unit comprising a number of actuators at the periphery of the unit, each having a movable thrust member which is displaceable outwardly for engagement with the formation of the borehole being drilled, means being provided to effect roll stabilization of the instrument carrier so that relative rotation between the bias unit and instrument carrier, as the bias unit rotates, operates the actuators in synchronism with rotation of the bias unit so as to apply a lateral bias thereto, the method comprising alternating periods when the carrier is roll stabilized and substantially stationary in space, causing maximum bias in the specified direction, with periods when the carrier is rotating in space, causing zero or reduced net bias per revolution.

24. A method of operating a steerable rotary drilling system of the kind where a bottom hole assembly includes, in addition to a drill bit, a modulated bias unit and a control unit including an instrument carrier which is rotatable about a longitudinal axis relative to the bias unit, the bias unit comprising a number of actuators at the periphery of the unit, each having a movable thrust member which is displaceable outwardly for engagement with the formation of the borehole being drilled, means being provided to effect roll stabilization of the instrument carrier so that relative rotation between the bias unit and instrument carrier, as the bias unit rotates, operates the actuators in synchronism with rotation of the bias unit so as to apply a lateral bias thereto, the method comprising rotating said instrument carrier, for a period, in a manner to neutralize or reduce the net bias per revolution applied to the bias unit during said period, and changing the mode of rotation of the carrier at intervals during said period.

25. A method according to claim 24, wherein said period includes at least one interval during which the instrument carrier is roll stabilized.

* * * * *